US006875099B2

(12) United States Patent
Stepanovich

(10) Patent No.: US 6,875,099 B2
(45) Date of Patent: Apr. 5, 2005

(54) POLISHING TOOL AND A COMPOSITION FOR PRODUCING SAID TOOL

(75) Inventor: Kondratenko Vladimir Stepanovich, Ostrovtsy (RU)

(73) Assignees: Kodratenko Vladimir Stepanovich, Moscow (RU); Grander Technology Limited, Sheung Wan (HK)

( * ) Notice: Subject to any disclaimer, the term of this patent is extended or adjusted under 35 U.S.C. 154(b) by 0 days.

(21) Appl. No.: 10/399,922

(22) PCT Filed: Oct. 17, 2001

(86) PCT No.: PCT/RU01/00424

§ 371 (c)(1),
(2), (4) Date: Apr. 24, 2003

(87) PCT Pub. No.: WO02/34469

PCT Pub. Date: May 2, 2002

(65) Prior Publication Data

US 2004/0005850 A1 Jan. 8, 2004

(30) Foreign Application Priority Data

| | | |
|---|---|---|
| Oct. 24, 2000 | (RU) | 2000126569 |
| Oct. 24, 2000 | (RU) | 2000126570 |
| Jul. 25, 2001 | (RU) | 2001120745 |

(51) Int. Cl.[7] ..... B24B 33/00
(52) U.S. Cl. ..... 451/548; 51/309
(58) Field of Search ..... 451/548, 541, 451/542, 540; 51/298, 299, 300, 307, 308, 309

(56) References Cited

U.S. PATENT DOCUMENTS 5,759,088 A * 6/1998 Kondratenko ..... 451/41

FOREIGN PATENT DOCUMENTS

| | | | |
|---|---|---|---|
| EP | 0 855 249 A | | 7/1998 |
| JP | 61-256030 | * | 11/1986 |
| JP | 5-335434 | * | 12/1993 |
| RU | 1780469 A1 | * | 10/1995 |
| SU | 795922 B | * | 1/1981 |
| SU | 952934 A | * | 8/1982 |
| SU | 975374 A | | 11/1982 |
| SU | 1613308 A | * | 12/1990 |
| SU | 1748972 A1 | * | 7/1992 |
| WO | WO 98/35788 A | | 8/1998 |

* cited by examiner

*Primary Examiner*—M. Rachuba
(74) *Attorney, Agent, or Firm*—Frishauf, Holtz, Goodman & Chick, P.C.

(57) ABSTRACT

A tool is provided which includes a chuck provided with abrasive elements in the form of pellets fixed thereto. Abrasive filler is arranged between the abrasive elements. The density and abrasive grit of the abrasive filler are in ranges of from 20 to 80% and from 1 to 50% with respect to the density and abrasive grit of the abrasive elements. A composition is provided which consists of epoxy resin, diamond-containing abrasive, a hardener, a filler and polyhydride siloxane. The polyhydride siloxane is used in order to form pores when reacting with the hardener during the production of the tool.

11 Claims, 2 Drawing Sheets

POLISHING TOOL AND A COMPOSITION FOR PRODUCING SAID TOOL

This application is a United States National Phase Application under 35 U.S.C. 371 of International Application No. PCT/RU01/00424 (not published in English) filed Oct. 17, 2001.

FIELD OF THE INVENTION

The invention pertains to the diamond-abrasive machining of various materials as well as to the manufacture of fixed abrasive tools.

The invention can be used in various industries for machining sapphire, quartz, ceramics, glass articles, semiconducting materials and various other materials. It may be efficiently used when processing miniature articles and thin large-sized articles, including double-sided machining without preparatory gluing of the articles being processed.

BACKGROUND OF THE INVENTION

Polishing tools for machining articles, which tools contain chucks with abrasive units in the form of pellets attached thereto (WO 94/17956), are well-known. The disadvantage of such polishing tools is that it is difficult and often impossible to machine thin large-sized articles (having a thickness ratio of $h/D \leqq 1/50$) without gluing the articles to a substrate before the machining. This could be explained in the following way. Since a fixed abrasive tool is able to work in a self-sharpening mode only under sufficiently high specific pressure, the compactness of chuck surface filling with abrasive pellets should be minimal. However such chuck filling with abrasive pellets is unacceptable when machining small-sized articles, as the small-sized articles simply fall through between the pellets. On the other hand, when machining thin large-size articles with a thickness ratio of $h/D \leqq 1/50$, low compactness of chuck filling with pellets results in deformation of thin bearing separators with processed articles, being attached to their sockets, under working load in course of operation. As a result of such deformation separators and parts hit against pellets located far from each other, deteriorate themselves, and damage the polishing tool. In order to avoid this problem, the space between pellets is often filled with various filling agents. For example, the space between pellets is filled with epoxy resin. However, this results in greasing of the tool and in difficulty of its operation.

A polishing tool, which is in technical terms the most similar to the tool of the present invention, is a tool containing a chuck with abrasive units attached thereto. The space between abrasive units is filled with filler containing abrasive (Inventor's Certificate USSR 1311921). In this polishing tool the abrasive units are in the form of flat plates and are attached endways to the chuck with an infill ratio of 0.05–0.15, and the space between the plates is filled with epoxy resin. The epoxy resin contains abrasive having grit equal to the grit of the flat abrasive plates or 1–2 numbers lower, and the quantity of the abrasive is 10–15% of the epoxy resin volume.

This polishing tool may be used in operations of preparatory roughing or primary polishing of some materials, which allows very high specific pressure during machining.

The disadvantage of such a polishing tool is in low effectiveness of polishing due to the presence of the epoxy resin between the abrasive plates. This is explained by the following reasons. In the first place, owing to sharp increase of total area of the polishing tool working surface, the specific pressure to the cutting tool decreases scores of times. For instance, in the case of the infill ratio range stated above, the specific pressure decreases from 7 to 20 times. Therefore it is necessary to heavily increase the total loading of the polishing tool and the machined articles. But that automatically results in deformation of the machined articles, and as a consequence in degradation of machining geometrics. During machining of miniature articles they often fail for the reason of overloading in the region of processing. In the second place, as is well known the epoxy resin causes greasing of the tool. The presence of abrasive in the epoxy resin is not able to provide operation of the polishing tool in the self-sharpening mode in full measure, as the factor of the greasing of the cutting surfaces of the abrasive plates noticeably predominates the factor of opening by means of abrasive released as a result of filler wear.

The composition for polishing tools including epoxy resin, hardener, abrasive, filler and a foaming agent as an adhesive is well-known (Inventor's Certificate USSR 1465439). A polishing tool made of this composition may be used efficiently enough for rough and semifinish glass polishing.

However, such tools are of little use in the case of processing high-strength hard-to-treat materials, and may not be used in operations of the final as well as preparatory polishing.

The composition which is the most similar to the composition of the present invention, is the composition designated for manufacture of abrasive tools containing adhesive using epoxy resin with hardener, diamond-containing abrasive and filler (Inventor's Certificate USSR 1311921).

The disadvantage of this composition is that tools manufactured with it may work only under sufficiently high specific pressure, and consequently, the infill ratio should not be high. This, as it was stated above, results in difficulty of operation of such tools during machining of miniature or small-sized articles.

SUMMARY OF THE INVENTION

The object of the present invention is to provide polishing tools and a composition for their manufacture, which are able to provide a sharp increase of productivity and quality of such intractable materials as sapphire, quartz, ceramics, semiconducting materials while machining, and which are effective for machining miniature and small-sized articles with a thickness ratio of $h/D \leqq 1/50$, which may be machined with great difficulty with traditional polishing tools.

To achieve the object of the present invention, a polishing tool is provided which includes a chuck with abrasive units attached thereto, and filler with abrasive filled in the space between the abrasive units, wherein the abrasive units are pellets, the filler density is 20–80% of the density of the abrasive pellets, and the grit of the filler abrasive is 1–50% of the grit of the abrasive pellets material. The filler in the space between the abrasive pellets may be realized in the form of auxiliary abrasive pellets attached to the surface of the chuck. The ratio of the basic and auxiliary abrasive pellets is preferably chosen in the range from 1:6 to 4:1. The filler may also be placed in the whole space between abrasive pellets, and foam epoxide, added with a composition of abrasive with a fine powder of aminoplast and/or phenoplast, is used as such filler. The proportion of abrasive and aminoplast and/or phenoplast in the filler is 15–30% and 10–40% of the foam epoxide mass, respectively. In this case the filler density may be 5–50% of the density of the abrasive pellets.

In addition, the object of the present invention is achieved by providing a composition for manufacture of the polishing tool which includes epoxy resin, diamond-containing abrasive, hardener, filler, and polyhydride siloxane in the following ratio (relative parts by weight):

| | |
|---|---|
| Epoxy resin | 100 |
| Hardener | 5.0–10 |
| Diamond-containing abrasive | 0.1–60 |
| Filler | 5.0–80 |
| Polyhydride siloxane | 0.2–5.0 |

The composition may additionally contain formic acid as a functional additive in amount of 10–10.0 relative parts by weight.

An abrasive including not less than 70% of cerium dioxide, microbeads made of silicon dioxide sized from 10 to 100 nm, graphite powder and finely dispersed metal powder may be used as a filler.

A composition of cerium dioxide with (i) aminoplast, which is a thermosetting pressing material, based on urea-, carbamide-, melamine- and/or carbamidemelamineformaldehyde resin, and/or (ii) phenoplast, which is also a thermosetting pressing material, based on formaldehyde resin, may be used as a filler. The cerium dioxide and aminoplast and/or phenoplast in the composition are in the ratio of 1:(0.1–10).

A composition of diamond dust and auxiliary abrasive, wherein corundum, silicon carbide, boron carbide, boron nitride or a combination thereof is the auxiliary abrasive, may be preferably used as the abrasive. The diamond dust and the auxiliary abrasive are in the ratio of (0.01–10):(50–0.5) relative parts by weight.

DETAILED DESCRIPTION

Figure 1:
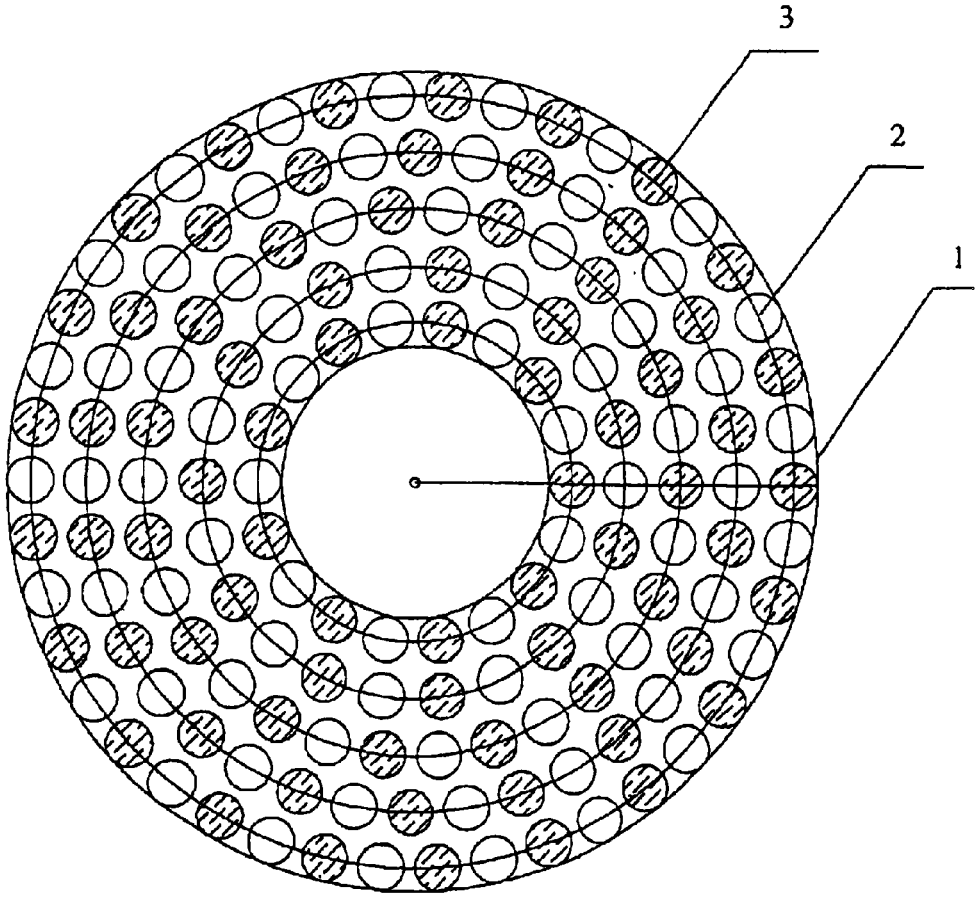
FIG. 1 displays a polishing tool with filler in the form of auxiliary pellets.

The polishing tool contains a chuck 1 with alternating basic abrasive pellets 2 and auxiliary abrasive pellets 3 attached thereto. In this polishing tool example (FIG. 1) the quantity of basic and auxiliary abrasive pellets are in an equal ratio, i.e. 1:1.

Figure 2:
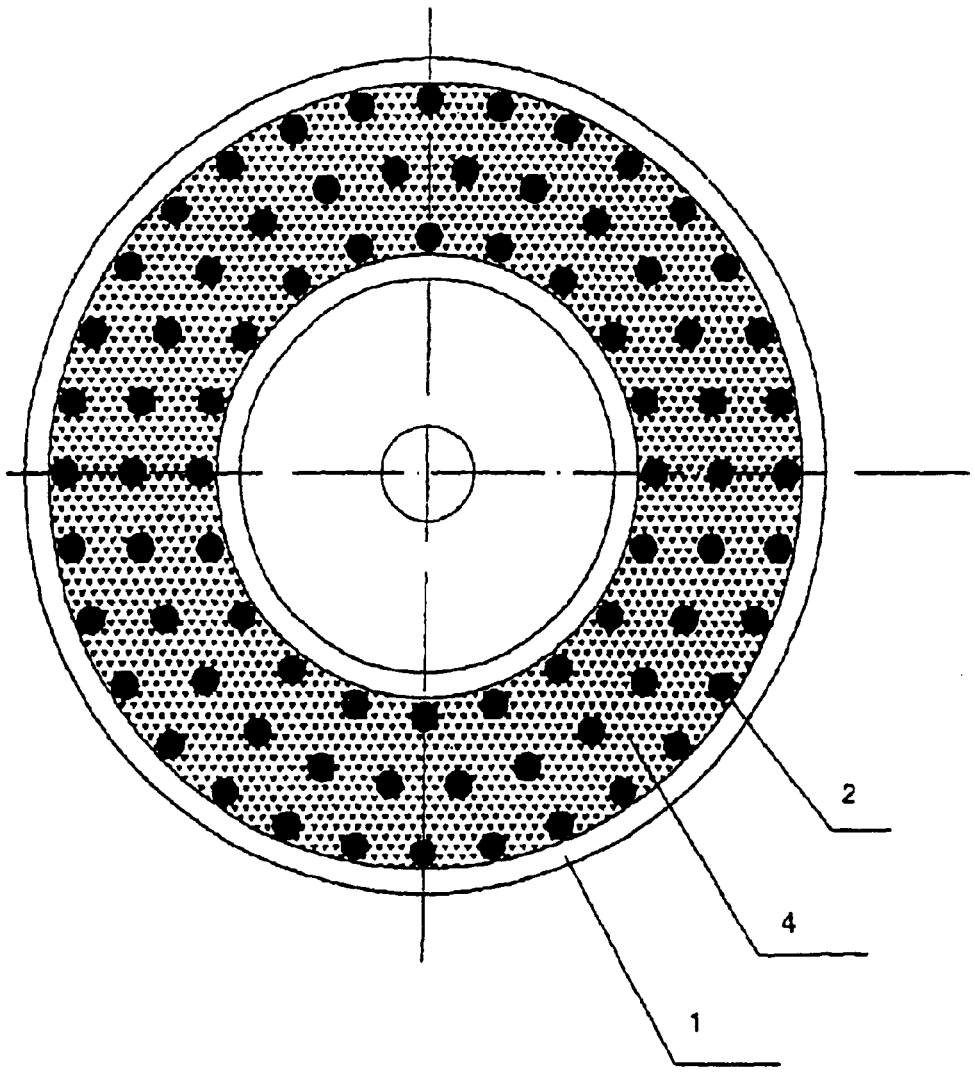
FIG. 2 displays a polishing tool with filler in the whole space between abrasive units.

FIG. 2 displays the polishing tool containing a chuck 1 with abrasive pellets 2 attached thereto, and with filler 4 flooding the space between them.

The polishing tool may be used in operations of one-sided and double-sided machining of flat as well as other surfaces.

In the process of machining miniature articles as well as machining of flat surfaces of thin articles having a thickness ratio of $h/D \leqq 1/50$ by means of a fixed diamond-abrasive tool, the following contradictions occur. On the one hand, it is necessary to maximize infill of the chuck surface with abrasive pellets. On the other hand, such infill results in a decrease of the specific pressure of the tool to the machined article. This decrease results in greasing of the polishing tool and in decrease of material takeoff. This problem is solved by utilizing auxiliary pellets or solid filler having density and solidity much lower than the density and solidity of the basic abrasive pellets. The auxiliary pellets are manufactured to be highly porous with interstice content in the range of 20–80%. In the event that the density of the auxiliary pellets mass is lower than 20% of the density of the basic pellets, i.e. in the event that gas phase content in the auxiliary pellets mass exceeds 80%, extremely high wear and intensive flaking of separate large-sized articles of pellets occur, that results in formation of scratches on the surface being machined. The utilization of auxiliary pellets with density higher than 80% of the density of the basic abrasive pellets does not provide an appreciable positive effect.

Wear of the auxiliary pellets takes place under the lower specific pressure. Therefore, even in the event that infill of the chuck surface exceeds 50%, that does not result in a sharp decrease of the specific pressure and does not result in greasing of the tool.

The usage of finer (from 2 to 100 times) abrasive in the mass of filler of the abrasive pellets provides the effect of an additional coercive opening of the working surface of the basic pellets. This makes it possible to use those pellets under much lower pressure. This causes some decrease of specific pressure to the basic abrasive pellets for the reason of high compactness of filling with auxiliary pellets to be compensated for by the effect of the additional opening of the basic pellets by the finer abrasive of the auxiliary pellets or by the solid filler. Furthermore, the decrease of the specific pressure results in an increase of machined surface forming precision, and the presence of additional abrasive in a machined region causes the roughness of the surface being machined to be reduced. It is necessary to note that in the filler it is unacceptable to use abrasive having grit which is more than 50% higher than the grit of the basic abrasive pellets, as that results in notable deterioration of the surface roughness as well as in formation of deep separate scratches on the surface of an article being machined. And utilization of abrasive having grit less than 1% of the grit of the basic abrasive pellets in the filler does not provide the effect of opening of the polishing tool working surface. For instance, in the case of using a polishing tool containing basic abrasive pellets with diamond dust having graininess 100/80 mm, auxiliary pellets using corundum as an abrasive with a grit of 5 $\mu$m, work efficiently.

The basic and auxiliary pellets quantity ratio is in a rather wide rage from 1:6 to 4:1. It is necessary to choose the required ratio of the basic and auxiliary pellets in every individual case. For example, in the case of machining of such hard and intractable materials as sapphire, synthetic quartz, and silicon carbide it is necessary to use high specific pressure. Therefore, in this case the optimal ratio of the basic and auxiliary pellets by quantity is from 1:1 to 1:4. The ratio of the basic and auxiliary pellets by quantity should not be less than 1:6, as the cutting ability of such a tool will be very low.

In the case of manufacture of a polishing tool with filler placed in the whole space between abrasive pellets, the base of such filler is foamed epoxy resin, which is a gas-filled material based on epoxy resin. This is hard material with a closed cell structure. It is of high mechanical durability even at increased working temperatures. Since foamed epoxy resin has high adhesive power in relation to most materials, foamed epoxy resin with abrasive additives and other components may be an ideal filler for flooding the space between abrasive pellets. The process of foaming and hardening of foamed epoxy resin is simple in technical terms, and it allows the density of the product gas-filled material to be controlled in a very wide range.

The density of the foamed epoxy resin may be controlled subject to methods and modes of foaming in the range from 0.02 to 0.4 g/cm$^3$. Besides, the compactness of the abrasive pellets, which may be used for manufacture of polishing tools, could be in the same wide range from several grams per cubic centimeter, for example, in case of diamond pellets on metal matrix, to several gram proportions per cubic centimeter in case of porous diamond pellets on organic matrix. Therefore, the density of the filler should be coordinated with the density of the abrasive pellets.

For polishing tools with solid filler the range of filler density in relation to the density of the abrasive pellets may be changed. The range of filler density, chosen for the polishing tool of the present invention is from 5 to 80% of the density of the abrasive pellets, and is determined by the following conditions. The bottom limit of the filler density—5% of the density of the abrasive pellets—makes it possible to machine materials under very low specific pressure, as such filler decreases the specific pressure to the working tool insignificantly. However, further extension of air interstices may result in flaking of large sized particles of the filler, which results in scratches on materials being machined.

In the process of defining of optimal abrasive grit used in the filler it was unambiguously ascertained that utilization of pellets all having the same grit, as that results in increased wear of the tool and the occurrence of rough scratches, and does not provide necessary surface roughness.

The utilization of fine-grained abrasive in the filler having grit which is 1–50% of the size of the grit of the abrasive pellets provides the best results for the operation of the polishing tool. In the first place, fine abrasive adheres well to thin walls of foamed epoxy resin cells, and as they wear it provides the effect of smooth opening of the working surface of the abrasive pellets.

The abrasive for the filler with grit that is 50% of the size of the grit of the abrasive pellets may be used for rough polishing tools or for tools used in extremely hard conditions of operation. Even this abrasive grit in the filler results in notable worsening of surface roughness and in increased tool wear. The utilization of abrasive with grit having less than 1% of the size of the grit of the abrasive pellets does not provide effective opening of the polishing tool working surface.

As was shown by pilot research, in the process of filler manufacture even for a rough polishing tool, using abrasive pellets with abrasive grit not less than 100 micrometers, abrasive grit for the filler may be equal 10–20 micrometers.

The infusion of finely dispersed powders of (i) aminoplast, which is a thermosetting pressing material based on urea-, carbamide-, malamine- and/or carbamide-melamineformaldehyde resin, and/or (ii) phenoplast, which is a thermosetting pressing material based on formaldehyde resin, in proportion of 10–40% of the foamed epoxy resin mass, into the foamed epoxy resin in addition to the abrasive results in fortification of the filler and provides the additional effect of tool opening. Besides that, this powder takes part in forming of the surface microrelief, and provides improvement of the surface roughness for one grade, when it wears and contacts a surface being machined.

Considering the fact that in the process of the filler manufacture fine grit abrasive together with fine-dyspersated power of aminoplast and/or phenoplast, having large total free surface, are used, the quantity of abrasive and aminoplast and/or phenoplast should not exceed 30% and 40%, respectively, of the mass of foamed epoxy resin. Otherwise unconnected abrasive clods may appear in the mass. Those clods will flake in the process of the polishing tool operation and affect conditions of such tool operation.

The minimal quantities of abrasive and fine dispersed powder of aminoplast and/or phenoplast are equal to 15% and 10%, respectively, of the mass of foamed epoxy resin, and are defined by conditions of provision of abrasive pellets working surface opening by means of releasing particles of abrasive and powder.

To achieve the object of the present invention, in addition to providing the above-mentioned polishing tool, it was necessary to create a composition for its manufacture. The composition for producing the polishing tool contains epoxy resin with hardener, for instance polyethylenepolyamine, as an adhesive. Additional utilization of an organosilicon liquid, namely polyhydride siloxane, in the amount of 0.2–5 relative parts by weight with respect to 100 relative parts by weight of the epoxy resin, results in formation of gas-expanded material. The formation of interstices is the result of reaction of polyethylenepolyamine with polyhydride siloxane, resulting in effervescence of hydrogen forming bubbles in the mass. The mass foaming process has three stages: interstices formation, expansion and stabilization. Depending on the quantity of polyhydride siloxane added to the mass as well as on modes of pore-formation and polymerization it is possible to control the quantity and size of the interstices in the product material in a very wide range. The ambient air temperature, mass temperature and mold temperature affect the process of pore-formation very noticeably. Therefore, for the purpose of production of the mass for manufacture of a tool with predetermined properties it is necessary to perform the process in strictly controlled conditions using special forms and thermostats. The presence of gas phase in the mass favorably affects the mechanical shockproofness of the tool. It has higher dynamic shockproof characteristics owing to the shock-absorbing capacity of the gas-expanded material.

It should be kept in mind that in the process of manufacturing the porous abrasive pellets, the density of the abrasive pellets affects their durability considerably. For example, in the case of contraction of a foamed abrasive pellet with density of 0.1 g/cm$^3$ the durability is about 4 kg-wt/cm$^2$, and in case of a pellet with density of 0.4 kg/cm$^3$ the durability is more than 80 kg-wt/cm$^2$. Therefore in the process of manufacturing the porous abrasive pellets, polyhydride siloxane in the amount of more than 5 relative parts by weight with respect to 100 relative parts by weight of epoxy resin should not be used for the reason of low durability of the product pellets.

It is necessary to lay stress on a special role of free hydrogen emerging in the region of tool cutting when opening cells filled with hydrogen.

As is well known, hydrogen is an ideal reducing agent. Interaction of hydrogen in the critical moment of its emission with various materials often plays a decisive role. When machining metals the reducing ability of hydrogen prohibits from formation of oxidic hard-to-machine pellicles. In the process of silicon machining, hydrogen, which is a reducing agent which binds to oxygen, inhibits the formation of silicon dioxide in the contact region, and thus prevents growth of submicron fractures and microfissures in the monolith silicon mass. In the process of machining of materials containing $SiO_2$, for example synthetic and fused quartz or various glass types, the presence of hydrogen prevents the formation of silicic acid pellicle gel, which is difficult to destroy, in the working zone. This effect of hydrogen facilitates a sharp decrease of specific pressure in the working region and, as a consequence, facilitates reduction of disrupted layer during materials machining.

There is one more positive effect of hydrogenous interstices being under pressure higher than atmospheric pressure. In the process of immediate pore opening microdestruction of the tool mass regions, adjacent to the emerged channel, occurs. That facilitates the additional effect of the tool self-sharpening.

The effect of positive impact of free hydrogen in the region of diamond tool cutting increases the presence of formic acid in the composition for the diamond tool. As is well known, when heated formic acid decomposes and hydrogen and carbonic acid are formed. Therefore in the cutting zone, where the local temperature considerably exceeds the temperature of formic acid decomposition, hydrogen is formed and intensifies and amplifies its reducing action to machined material.

Besides, the formic acid, dissolving in aqueous solution of lubricating fluid, stimulates loosening and renovation of the diamond tool working surface.

A special role of the filler in the proposed composition for diamond tools should be noted.

In the known compositions cerium dioxide played the role of just an auxiliary abrasive. However the presence of cerium dioxide itself as filler or as "an auxiliary abrasive" results in the fact that diamond tools may work in the self-sharpening mode only under increased specific pressure. This concerns structure of cerium dioxide particles of plate-like structure. On the one hand, large-size particles of the filler, capable of scratching the machined material, do not flake as they wear. On the other hand, the plate-like structure of cerium dioxide causes tool greasing.

Therefore, the usage of the composition of abrasive, based on not less than 70% of cerium dioxide, microbeads made of silicon dioxide, sized from 10 to 100 nanometers, graphite powder and finely dispersed metal powder in the composition for diamond tools as filler makes it possible to scientifically increase operating performance of the tools. That is determined by the following. The interchange of abrasive plate-like particles, sized from 1 to 8 micrometers, and microbeads made of silicon dioxide, sized from 10 to 100 nanometers, causes microdestruction of the abrasive particles, which inhibits greasing of tools in the process of their operation. Such combination of the filler is especially important for the manufacture of diamond tools with respect to finish and preparatory polishing using fine diamond dust sized less than 10 micrometers.

The inclusion of graphite powder, having a plate-like structure, makes the lubricating properties of the diamond tools much better. It is especially effective to use graphite powder in the filler composition in the process of diamond tool manufacture for the purpose of machining of such materials as high-strength ceramics, steel and other materials.

Since the basic components of the described composition for diamond tools are organic components with rather low thermal conductivity properties, there are difficulties in operation of the diamond tools under severe operation conditions, namely under high specific pressure and high processing speed. Therefore to improve operating properties of the diamond tools, fine dispersed metal powder is included into the filler composition. The metal powder increases heat removal from the working zone.

In another variant of the composition, cerium dioxide and (i) aminoplast, which is a thermosetting pressing material based on urea-, carbamide-, melamine- and/or carbamide-melamineformaldehyde resin, and/or (ii) phenoplast, which is a thermosetting pressing material based on formaldehyde resin, are used in the amount of 5–80 relative parts by weight. Cerium dioxide and aminoplast and/or phenoplast are in a ratio of 1:(0.1–10). The separate usage of cerium dioxide and aminoplast or phenoplast does not meet the requirements. The usage of only cerium dioxide as filler in the mass for abrasive tool manufacture results in worsening of the cutting ability of the tool and in an inclination for greasing. Besides that, for the reason of inclination of cerium dioxide aggregation there are clods appearing in the mass for abrasive tool manufacture. Those clods inhibit operating properties of the tool. The usage of only aminoplast or phenoplast as filler results in excessively high solidity of the abrasive pellets that requires increased specific pressure in the process of the tool operation. The best results were achieved when the composition of cerium dioxide and aminoplast and/or phenoplast in the amount of 5–80 relative parts by weight with their proportion in the composition equal to 1:(0.1–10) was used as filler for the manufacture of the abrasive tool. Owing to usage of this composition as filler it was a success to considerably improve machining quality as well as productivity of polishing tools due to reduction of specific pressure in the working zone. In the process of usage of the abovementioned composition formation of conglomerates, when mixing components, was completely avoided.

The usage of the composition of diamond dust and auxiliary abrasive in the mass for abrasive tool manufacture results in significant improvement of machining performance of the tools. Corundum, silicon carbide, boron carbide, boron nitride or a combination thereof may be used as the auxiliary abrasive. Depending on the intended task the ratio of diamond dust and auxiliary abrasive in total may be varied within the range (0.01–10):(50–0.5) relative parts by weight. Such a wide range makes it possible to obtain a wide variety of polishing tools for various applications. In the process of manufacturing the auxiliary abrasive pellets it is necessary to use a minimal quantity of diamond dust, but a maximal quantity of auxiliary abrasive. And conversely, in the process of manufacturing the basic abrasive pellets it is necessary to use mainly diamond dust with insignificant addition of auxiliary abrasive. As it was stated above, corundum, silicon carbide, boron carbide, boron nitride or a combination thereof may be used as the auxiliary abrasive. The harder the machined material, the more durable the auxiliary abrasive should be.

The diamond tool in the form of pellets is manufactured in the following way. The components are blended into epoxy resin under thorough agitation in the following order: diamond dust, filler, formic acid, polyhydride siloxane and hardener. After that the mass is agitated till homogeneous consistency is achieved. The mass should be matured within 1–15 minutes depending on the composition and the volumetric content of polyhydride siloxane. After that, molds are filled with the foamed mass being strictly closed. The mass is matured within 12–24 hours. The diamond pellets are then withdrawn from molds. After that, the product diamond pellets are heat-treated at 60–110° C. for 0.5–4 hours.

Diamond tools manufactured with usage of diamond pellets with the described composition were tested in the laboratory and in an industrial environment on a double-sided processing machine model SDP-100 in machining of various materials.

The following data shows results of testing of a diamond tool, manufactured on the basis of the composition of the present invention, in the process of machining of silicon wafers 100 mm in diameter. The polishing tools represent metal chucks 500 mm in outer diameter and 287 mm in interior diameter. Diamond pellets 16 mm in diameter and 6 mm in height are attached to the chucks by means of two-part adhesive, 210 units per each chuck. The diamond pellets were manufactured in compliance with the blending ratios indicated in Table 1.

TABLE 1

| | Components content, relative parts by weight | | | | | | | | | |
|---|---|---|---|---|---|---|---|---|---|---|
| Number of instances | 1 | 2 | 3 | 4 | 5 | 6 | 7 | 8 | 9 | 10 |
| Components | | | | | | | | | | |
| Epoxy resin | 100 | 100 | 100 | 100 | 100 | 100 | 100 | 100 | 100 | 100 |
| Hardener | 7 | 7 | 7 | 7 | 6.5 | 6.5 | 10 | 5 | 6.5 | 6.5 |
| Diamond powder | 0.1 | 30 | 5 | 5 | 3 | 3 | 5 | 5 | 3 | 3 |
| Filler | | | | | | | | | | |
| Optical Polirit | 20 | 20 | 20 | 50 | 10 | 5 | 70 | 30 | 30 | 30 |
| Microbeads $SiO_2$ | — | — | 5 | 10 | 1.5 | — | 5 | 5 | — | — |
| Graphite powder | 2 | 2 | 5 | 5 | 1 | — | 3 | — | 5 | — |
| Copper powder | 2 | — | — | 5 | 2 | — | 2 | — | — | — |
| Formic acid | 2 | 2 | — | — | 5 | 10 | 2 | 1 | 2 | 2 |
| Polyhydride siloxane | 0.4 | 4 | 2 | 2 | 2 | 3 | 3 | 3 | 1 | 1 |
| Machining Parameters | | | | | | | | | | |
| Area efficiency, micrometers/min | 0.3 | 1.5 | 2 | 2.2 | 1.5 | 0.8 | 0.9 | 1 | 1.4 | 1.2 |
| Surface roughness, Ra, nanometers | 25 | 20 | 15 | 7 | 10 | 21 | 18 | 22 | 24 | 22 |
| Faulted layer depth, micrometers | 3 | 2 | 2 | 0.5 | 0.5 | 1.5 | 1.8 | 1.7 | 1.4 | 1.6 |

The quantity of polyhydride siloxane in the composition for the diamond tool of the present invention is chosen in the range from 0.4 to 4 relative parts by weight with respect to 100 relative parts by weight of epoxy resin. When using less than 0.4 relative parts by weight of the foaming agent, very insignificant pore-formation occurs. That does not provide required effect, when using the diamond tool of this composition.

Use of more than 4 relative parts by weights of polyhydride siloxane should be avoided in the process of manufacturing the porous diamond tool, as this will result in reduction of diamond tool strength and in sharp reduction of its durability.

The optimal range of formic acid quantity in this composition is from 1 to 10 relative parts by weight. The bottom of formic acid quantity is determined by minimal quality of hydrogen emission, which still exerts positive influence upon machined material in the process of its machining. In case of using more than 10 relative mass portions of formic acid, it partially reacts with the hardener, which results in incomplete polymerization and, as a consequence, in non-operability of the diamond tool that is manufactured.

The testing was performed under the following machining modes:

| | |
|---|---|
| Chuck rotation speed, revolutions/s | 35 |
| Specific pressure, kilogram-force/$cm^3$ | 0.03 |

The comparative results of testing of the described diamond tool on the basis of the composition of the present invention (#1) and on the basis of known composition (#2) in the process of silicon wafers machining are indicated below:

| Machining Parameter/Number of Composition | #1 | #2 |
|---|---|---|
| Area efficiency, micrometers/min | 1.5 | 0.2* |
| Surface roughness, Ra, nanometers | ≦0.01 | 0.12 |
| Faulted layer depth, micrometers | 0.5 | 5 |

*Note: In the process of diamond tool testing based on the known composition, it was noticed that the tool becomes greasy rapidly and deep scratches appear. This was absolutely absent when testing the diamond tool of the present invention.

Fixed abrasive pellets may be manufactured in the following way. The composition of diamond dust and auxiliary abrasive is prepared and thoroughly agitated separately. The composition of cerium dioxide and an aminoplast and/or phenoplast is prepared separately.

At room temperature the components are blended into epoxy resin under thorough agitation in the following order: the composition of diamond dust and auxiliary abrasive, the composition of cerium dioxide and aminoplast and/or phenoplast, polyhydride siloxane and polyethylenepolyamine. The mass is agitated until homogeneous consistency is achieved and is filled into molds being strictly dosed by means of a batcher. The mass in the molds is matured until the pore-formation process ends. After the mass in the molds matures at room temperature for not less than 12 hours, the abrasive pellets are withdrawn from the molds and heat-treated at 70–90 degrees Celsius for 0.5–4 hours.

Polishing tools manufactured with this composition were tested in the laboratory and in an industrial environment on a double-sided processing machine model SDP-100 in machining of various materials. Let us cite data on results of testing of the described tool, manufactured on the basis of the composition of the present invention in the process of machining of sapphire disks 100 mm in diameter. The polishing tools represent aluminium chucks 500 mm in outer diameter and 287 mm in interior diameter. Basic and auxiliary pellets 16 mm in diameter and 6 mm in height are attached to the chucks by means of two-part adhesive, 420 units per each chuck. Diamond pellets on organic binding material of PT100PI type, manufactured by "OOO Precisionnie Protsessi") (Moscow), were used as basic abrasive pellets. The diamond cut of those pellets is 100/80 micrometers. Abrasive pellets, manufactured in conformity with the invention with components ratio indicated in Table 2, were used as auxiliary abrasive pellets.

TABLE 2

| | Components content, relative parts by weight | | | | | | | | | |
|---|---|---|---|---|---|---|---|---|---|---|
| Numbers of instances | 1 | 2 | 3 | 4 | 5 | 6 | 7 | 8 | 9 | 10 |
| Components | | | | | | | | | | |
| Epoxy resin | 100 | 100 | 100 | 100 | 100 | 100 | 100 | 100 | 100 | 100 |
| Hardener | 7 | 7 | 7 | 7 | 5 | 6.5 | 10 | 7 | 6.5 | 6.5 |
| Diamond containing abrasive | 0.1 | 60 | 25 | 37 | 30 | 61 | 15 | 55 | 12 | 12 |
| Including: Diamond powder | 0.1 | — | 2 | 2 | 3 | 1 | 5 | 5 | 2 | 2 |
| Corundum | — | 60 | 20 | 20 | — | 20 | 10 | 25 | 10 | 10 |
| Silicone carbide | — | — | 3 | 15 | 15 | 20 | — | 25 | — | — |
| Boron carbide | — | — | — | — | 12 | 10 | — | — | — | — |
| Boron nitride | — | — | — | — | — | 10 | — | — | — | — |
| Filler | | | | | | | | | | |
| Optical Polirit | 20 | 1 | 20 | 20 | — | 4.5 | 10 | 10 | — | — |
| Aminoplast | 20 | 10 | 20 | 20 | 40 | 0.5 | 40 | 5 | 25 | — |
| Phenoplast | 10 | — | — | — | 20 | — | — | 15 | 25 | 45 |
| Formic acid | — | — | — | — | — | — | — | 1 | — | 2 |
| Polyhydride siloxane | 0.2 | 3 | 4 | 4 | 3 | 5 | 3 | 3 | 2 | 2 |
| Tool Parameters | | | | | | | | | | |
| Abrasive units density, g/cm$^3$ | 1.5 | 1.5 | 1.5 | 1.5 | 1.5 | 1.5 | 1.0 | 1.0 | 1.0 | 1.0 |
| Filler density, g/cm$^3$ | 1.2 | 0.8 | 0.5 | 0.7 | 0.9 | 0.3 | 0.5 | 0.6 | 0.5 | 0.7 |
| Machining Parameters | | | | | | | | | | |
| Area efficiency, micrometers/min | 0.5 | 60 | 52 | 80 | 34 | 28 | 42 | 44 | 4 | 2.2 |
| Surface roughness, Ra, micrometers | 0.02 | 0.28 | 0.30 | 0.32 | 0.12 | 0.14 | 0.1 | 0.12 | 0.03 | 0.04 |

Notes:

1. In the instances 1, 9 and 10 in basic abrasive pellets synthetic diamond powder of ACM brand with diamond cut 5/3 micrometers was used, in the instances 2, 3 and 4 diamond powder of AC4 brand with diamond cut 50/40 micrometers was used, and in the instances 5–8 diamond powder of AC4 brand with diamond cut 20/14 micrometers was used.

The grit of auxiliary abrasive indicated in Table 2 is 1–50% of the size of the grit of the basic abrasive pellets.

2. In the instances 2,5 and 6 the basic and auxiliary abrasive pellets were in a ratio of 1:1, in the instances 4,7,8 and 9 the ratio was 4:1, and in the instances 1,3 and 10 the ratio was 1:6.

As it follows from aforecited results, the proposed polishing tool, manufactured in compliance with proposed invention, has high cutting properties and provides high quality of machining.

What is claimed is:

1. A composition for manufacturing an abrasive element of a polishing tool, said composition comprising an epoxy resin, a diamond containing abrasive, a hardener, a filler, and polyhydride siloxane in the following parts by weight:

| | |
|---|---|
| epoxy resin | 100 |
| hardener | 5.0–10 |
| diamond containing abrasive | 0.1–60 |
| filler | 5.0–80 |
| polyhydride siloxane | 0.2–50. |

2. The composition according to claim 1, wherein said composition additionally contains a functional additive comprising formic acid in an amount of 1.0–10 parts by weight.

3. The composition according to claim 1, wherein said filler is a composite of an abrasive comprising not less than 70% of cerium dioxide, microbeads made of silicon dioxide sized from 10 to 100 nanometers, a graphite powder and a finely dispersed metal powder.

4. The composition according to claim 2, wherein said filler is a composite of an abrasive comprising not less than 70% of cerium dioxide, microbeads made of silicon dioxide sized from 10 to 100 nanometers, a graphite powder and a finely dispersed metal powder.

5. The composition according to claim 1, wherein said filler is a composite of cerium dioxide and at least one of: (i) aminoplasts, said aminoplasts being a thermosetting pressing material and comprising urea-, carbamide-, melamine-, and/or cabamidemelamineformaldehyde resin, (ii) phenoplasts, said phenoplasts being a thermosetting pressing material and comprising formaldehyde resin, wherein said cerium dioxide and said at least one of the aminoplast and the phenoplast in the composite are in a ratio of 1:(0.1–10).

6. The composition according to claim 1, wherein said diamond containing abrasive is a composite of diamond dust with an auxiliary abrasive, said auxiliary abrasive being one of: corundum, silicon carbide, boron carbide, boron nitride, and a mixture thereof, wherein a ratio of the diamond dust and the auxiliary abrasive in the composite is in a range of (0.01–10):(50–0.5) in parts by weight.

7. A polishing tool, comprising:

a chuck with abrasive units attached thereto, a filler containing an abrasive, placed in space between the abrasive units, wherein the abrasive units comprise the composition according to claim 1 and are abrasive pellets, wherein a filler density is 20–80% of a density of the abrasive pellets, and wherein a grit of the filler abrasive is 1–50% of a grit of the abrasive pellets.

8. The polishing tool according to claim 7, wherein the filler comprises auxiliary abrasive pellets attached to a surface of the chuck.

9. The polishing tool according to claim 8, wherein a quantity ratio of basic pellets and auxiliary pellets is in a range from 1:6 to 4:1.

10. The polishing tool according to claim 7, wherein the filler is placed in an entire space between abrasive units, and wherein the filler is a composite of a foam oxide and a mixture of abrasive and at least one of a finely dispersed aminoplast powder and phenoplast powder, wherein a quantity of the abrasive and said at least one of the aminoplast powder and the phenoplast powder in the filler is 15–30% and 10–40%, respectively, of the mass of the penepoxide.

11. The polishing tool according to claim 10, wherein a density of the filler is 5–20% of a density of the abrasive pellets.

* * * * *

UNITED STATES PATENT AND TRADEMARK OFFICE

CERTIFICATE OF CORRECTION

PATENT NO. : 6,875,099 B2
DATED : April 5, 2005
INVENTOR(S) : V.S. Kondratenko

It is certified that error appears in the above-identified patent and that said Letters Patent is hereby corrected as shown below:

Title page,
Item [12], change "Stepanovich" to -- Kondratenko --;
Item [75], Inventors, change "Kondratenko Vladimir Stepanovich" to -- Vladimir Stepanovich Kondratenko --; and
Item [73], Assignees, change "Kondratenko Vladimir Stepanovich" to -- Vladimir Stepanovich Kondratenko --.

Column 11,
Line 67, change "0.2-50." to -- 0.2-5.0. --.

Signed and Sealed this

Fifteenth Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,875,099 B2
APPLICATION NO. : 10/399922
DATED : April 5, 2005
INVENTOR(S) : Kondratenko It is certified that error appears in the above-identified patent and that said Letters Patent is hereby corrected as shown below:

Title Pg, Item (75) Inventors:

change "Ostrovtsy" to --Moscow--.

Signed and Sealed this

Eighteenth Day of March, 2008

JON W. DUDAS
*Director of the United States Patent and Trademark Office*